US006148161A

United States Patent [19]

Usui et al.

[11] Patent Number: 6,148,161

[45] Date of Patent: Nov. 14, 2000

[54] IMAGE FORMING APPARATUS WITH IMPROVED TONER DENSITY CONTROL

[75] Inventors: Noriyuki Usui, Kawasaki; Ken Amemiya, Nerima-ku; Haruji Mizuishi, Ohta-ku; Mayumi Ohori, Kawasaki; Masaru Tanaka; Kenzo Tatsumi, both of Yokohama; Toshitaka Yamaguchi, Ohmiya; Hideki Zemba, Yokohama; Hiroshi Mizusawa, Ohta-ku, all of Japan

[73] Assignee: Ricoh Company, Ltd., Tokyo, Japan

[21] Appl. No.: 09/414,857

[22] Filed: Oct. 12, 1999

[30] Foreign Application Priority Data

Oct. 14, 1998 [JP] Japan ..... 10-292215

[51] Int. Cl.[7] ..... G03G 15/10; G03G 15/08

[52] U.S. Cl. ..... 399/58; 399/62; 399/254

[58] Field of Search ..... 118/689, 693; 399/27, 28, 29, 30, 49, 53, 55, 56, 58, 59, 62, 253, 254, 258, 262, 263, 224; 430/106, 110

[56] References Cited

U.S. PATENT DOCUMENTS

| | | | |
|---|---|---|---|
| 4,885,466 | 12/1989 | Koichi et al. . | |
| 5,162,849 | 11/1992 | Yoshino et al. | 399/62 |
| 5,357,317 | 10/1994 | Fukuchi et al. | 399/62 |
| 5,581,326 | 12/1996 | Ogata et al. | 399/62 |
| 5,678,125 | 10/1997 | Kutsuwada et al. . | |
| 5,815,767 | 9/1998 | Kutsuwada et al. . | |

*Primary Examiner*—Arthur T. Grimley
*Assistant Examiner*—Hoang Ng
*Attorney, Agent, or Firm*—Oblon, Spivak, McClelland, Maier & Neustadt, P.C.

[57] ABSTRACT

An image forming apparatus includes an image carrier and a developing device to develop a latent image formed on the image carrier by applying two-component developer, including toner, onto the latent image. The developing device includes a developing part containing the two-component developer and a developer stirring device to stir the two-component developer. A toner supplying device supplies toner to the developing part of the developing device, and a toner density detection device detects a toner density of the two-component developer in the developing device. A toner control device calculates a difference between an output value VT of the toner density detection device and a criterion value VTref for controlling the toner density of the two-component developer and controls the toner supplying device based upon the difference. An image density detection device detects an image density of a criterion image formed on the image carrier, and a criterion value correcting device corrects the criterion value VTref based upon an output value of the criterion image density detection device. A decision as to whether to stir the developer in the developing device with the developer stirring device is made based upon a difference between the criterion value VTref and the output value VT from the toner density detection device and an output value of the criterion image density detection device when an image forming operation is started.

25 Claims, 6 Drawing Sheets

TABLE 1

| Vsp/Vsg | Vsp(V) | VTref−VT | LOW | | TONER DENSITY | | HIGH |
|---|---|---|---|---|---|---|---|
| | | | −0.3≧ | −0.3< ≦−0.1 | −0.1< ≦0.1 | 0.1< ≦0.3 | ≧0.3 |
| IMAGE DENSITY LOW | 0.19< | 0.76< | 0 | −0.1 | −0.2 | −0.2 | −0.2 |
| | 0.19≧ >0.16 | 0.76≧ >0.64 | 0 | −0.1 | −0.1 | −0.1 | −0.1 |
| | 0.16≧ >0.13 | 0.64≧ >0.52 | 0 | −0.05 | −0.05 | −0.05 | −0.05 |
| | 0.13≧ >0.10 | 0.52≧ >0.4 | | 0 | 0 | 0 | 0 |
| | 0.10≧ >0.07 | 0.40≧ >0.28 | STIRRING MODE | 0 | 0.05 | 0 | 0 |
| IMAGE DENSITY HIGH | 0.07≧ >0.05 | 0.28≧ >0.20 | | 0.05 | 0.1 | 0.05 | 0 |
| | 0.05≧ | 0.20≧ | | 0.1 | 0.2 | 0.1 | 0 |

*FIG. 6*

TABLE 2

| VT−VTref(V) | STIRRING TIME (SEC) | REMAINING STIRRING TIME (SEC) | VTref CORRECTING AMOUNT (V) |
|---|---|---|---|
| 0~0.3 | 0 | 0 | 0 |
| 0.3~0.5 | 200 | 200 ~100 | 0.2 |
| 0.5~0.7 | 400 | 400 ~200 | 0.4 |
| 0.7~ | 600 | 600 ~400 | 0.6 |

FIG. 7

IMAGE FORMING APPARATUS WITH IMPROVED TONER DENSITY CONTROL

BACKGROUND OF THE INVENTION

1. Field of the Invention

The present invention relates to image forming apparatuses, such as copying machines, printers, facsimile machines, etc., and more particularly relates to an image forming apparatus that controls toner density of developer in a developing device to be constant by controlling toner supply to the developing device.

2. Discussion of the Background

In image forming apparatuses, such as copying machines, printers, facsimile machines, etc., an electrostatic latent image is formed on an image carrier, such as a photoconductor, and the latent image formed on the image carrier is developed into a visible toner image by supplying two-component developer, including toner, onto the latent image from a developing device. The developed toner image is then transferred to a transfer sheet. A developing bias voltage is applied to the developing device from a developing bias power source when the latent image is developed by the developing device, and toner is supplied to the developing device from a toner supplying device.

In such image forming apparatuses, because the toner density of two-component developer affects the density of an image to be developed with the developer, it is desirable to maintain the toner density of the two-component developer in the developing device constant. Therefore, a sensor, generally referred to as a "T" sensor, is provided in the developing device to detect the toner density of the two-component developer in the developing device. A detection result of the "T" sensor is compared with a criterion value for the toner density of the two-component developer. Then, the toner supply to the developing device from the toner supplying device is controlled according to a result of the comparison so that the toner density of the developer in the developing device is kept constant.

Further, the density of an image developed with developer significantly changes according to a change in the characteristics of the developer with the passage of time, the environmental conditions, such as temperature or humidity, or the developing conditions.

Therefore, generally, for obtaining toner images having a desired image density in a stable manner, a criterion image is formed on a surface of the image carrier with a predetermined criterion developing potential, which is a difference between a surface potential of a photoconductor as the image carrier and a developing bias potential. Then, the image density of the criterion image is detected by a reflective photo sensor, generally referred to as a "P" sensor. The criterion value for the toner density of two-component developer is then corrected according to a result of detecting the image density of the criterion image, and the toner supply to the developing device from the toner supplying device is controlled according to the corrected criterion value for the toner density.

Further, a method has been proposed in which a threshold value is provided for the criterion value for the toner density of two-component developer and the criterion value for the toner density is controlled such that the toner density of the two-component developer does not fall below a predetermined toner density.

More specifically, in such a method, each time an image forming operation is performed, the toner density of two-component developer in a developing device is detected by the "T" sensor and the quantity of toner to be supplied to the developing device is controlled according to a result of comparing an output value VT of the "T" sensor resulting from the detection and a criterion value VTref for the toner density. In addition, each time a predetermined number of images have been formed, a criterion image is formed on a photoconductor, the image density of the criterion image is detected by the "P" sensor, and a correcting amount ΔVT for the criterion value VTref for the toner density is determined according to the output value of the "P" sensor resulting from the detection. A new criterion value VTref for the toner density is then determined based upon the correcting amount ΔVT and the output value VT of the "T" sensor at the time of forming the criterion image. For example, the new criterion value VTref equals the previous criterion value VTref plus the correcting amount ΔVT, i.e., $VTref_{new} = VTref_{previous} + \Delta VT$. When the new criterion value $VTref_{new}$ is smaller than a threshold value, the new criterion value $VTref_{new}$ is set as the criterion value for the toner density. When the new criterion value $VTref_{new}$ is larger than the threshold value, the threshold value is set as the criterion value for the toner density. The criterion value thus set is used for controlling the quantity of toner to be supplied to the developing device until the criterion image is formed next.

The above method has, however, a problem such that when an image forming operation is started after the image forming apparatus has been left unused for a long time under high temperature and high humidity, conditions for example during a summer vacation, an output value of the "T" sensor erroneously becomes higher than the output value before the apparatus had been left unused, for example by about 0.8 V, as illustrated in FIG. 1. If such an output value of the "T" sensor, which is erroneously higher than a normally detected value by about 0.8 V, is used as the output value of the "T" sensor, the toner density is determined as about 1.5 wt % lower than the actual toner density, as illustrated in FIG. 2. As a result, an excessive amount of toner is supplied and thereby the image density becomes excessively high. It has been known that the above erroneously higher output value VT of the "T" sensor is caused by a change in the density of the developer, which occurs when an image forming apparatus has been left unused for a long time.

An increase in the image density, which is caused by an error in the output value of the "T" sensor due to a change in the characteristics of developer, such as a change in the density of the developer as above, is too significant to be corrected by correcting the criterion value VTref for the toner density according to an output value of the "P" sensor such that the quantity of toner to be supplied is decreased. Even if the above increase in the image density due to the error in the output value of the "T" sensor is corrected for an initial stage of the image forming operations after a long period of non-use of the apparatus by correcting the criterion value VTref for the toner density such that the quantity of toner to be supplied is decreased, the output value VT of the "T" sensor returns to a normal value after the developer in the developing device has been stirred, for example for about 5 minutes, or after about 100 copies have been made, as illustrated in FIG. 1. Therefore, after the output value VT of the "T" sensor returns to the normal value, it occurs that the necessary quantity of toner is not supplied, and thereby the image density is decreased, because the criterion value VTref has been corrected such that the quantity of toner to be supplied is decreased and the same criterion value VTref is used until the criterion image is formed next and the criterion value VTref is again corrected according to an output value of the "P" sensor.

SUMMARY OF THE INVENTION

The present invention has been made in view of the above-discussed and other problems and addresses the above-discussed and other problems.

A preferred embodiment of the present invention provides a novel image forming apparatus that prevents change in the toner density of developer, which is caused by significant change in the characteristics of the developer due to, for example, changes in the environmental conditions or with the passage of time, and that thereby prevents background soiling and increases stability of the image density.

Another preferred embodiment of the present invention provides a novel image forming apparatus that decreases the effect of change in the characteristics of developer, and thereby prevents increase of the toner density due to the change in the characteristics of the developer, and that thereby further prevents producing an inferior image, such as an image having a soiled background.

Another preferred embodiment of the present invention provides a novel image forming apparatus that controls the toner density in a stable manner, and that thereby prevents background soiling and stabilizes the image density.

According to a preferred embodiment of the present invention, a novel image forming apparatus includes an image carrier and a developing device to develop a latent image formed on the image carrier by applying two-component developer including toner onto the latent image. The developing device includes a developing part containing the two-component developer and a developer stirring device to stir the two-component developer. A toner supplying device supplies toner to the developing part of the developing device, and a toner density detection device detects a toner density of the two-component developer in the developing device. A toner control device calculates a difference between an output value VT of the toner density detection device and a criterion value VTref for controlling the toner density of the two-component developer, and controls the toner supplying device based upon the difference. An image density detection device detects an image density of a criterion image formed on the image carrier, and a criterion value correcting device corrects the criterion value VTref based upon an output value of the criterion image density detection device. A decision as to whether to stir the developer in the developing device with the developer stirring device is made based upon a difference between the criterion value VTref and an output value VT from the toner density detection device and an output value of the criterion image density detection device when an image forming operation is started.

According to the present invention, a stirring time to stir the developer in the developing device with the developer stirring device may be determined when the decision is made to stir the developer. Further, the developer stirring time may be determined according to the difference between the criterion value VTref and the output value VT from the toner density detection device when the image forming operation is started. Furthermore, a decision as to whether to correct the criterion value VTref may be made based upon the developer stirring time, and a correcting amount for the criterion value VTref may be determined according to the developer stirring time.

According to another embodiment of the present invention, the decision to stir the developer may be made when the difference between the criterion value VTref and the output value VT of the toner density detection device is equal to or less than a threshold value and the output value of the criterion image density detection device is equal to or less than a predetermined value.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 6 is a table for determining whether to stir the developer and for determining a correcting amount for the criterion value for the toner density; and FIG. 7 is another table for determining a developer stirring time and a corresponding correcting amount for the criterion value for the toner density.

DESCRIPTION OF THE PREFERRED EMBODIMENTS

Figure 1:
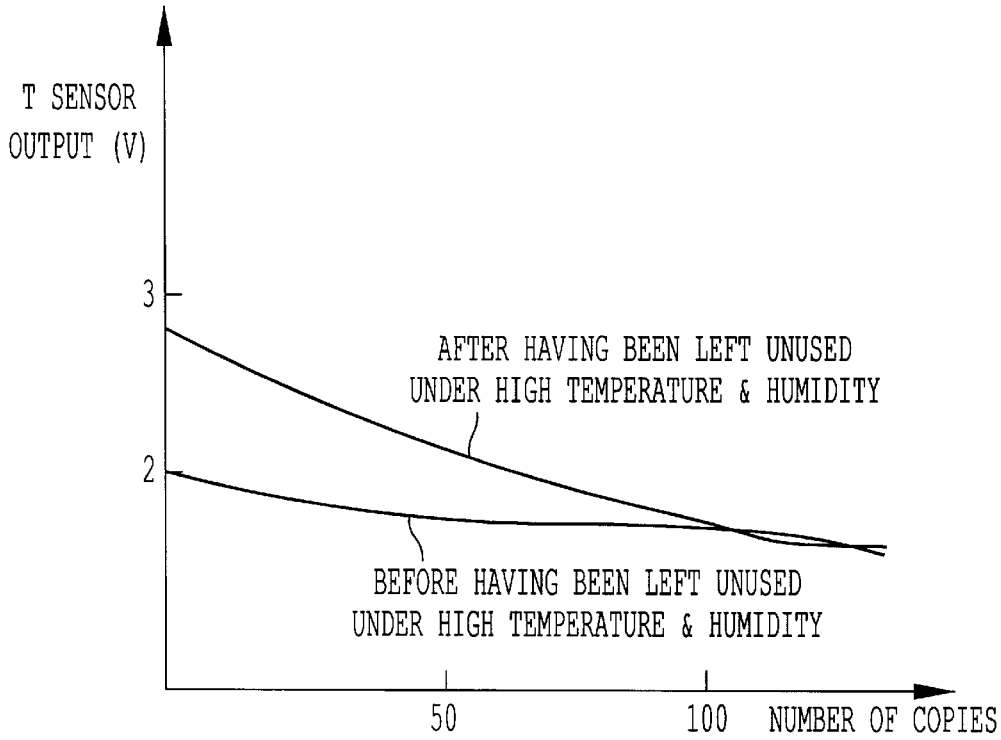
FIG. 1 is a diagram illustrating a relationship between the number of copies and the output of a "T" sensor of an image forming apparatus before and after the apparatus has been left unused for a long time under high temperature and humidity conditions.
Figure 2:
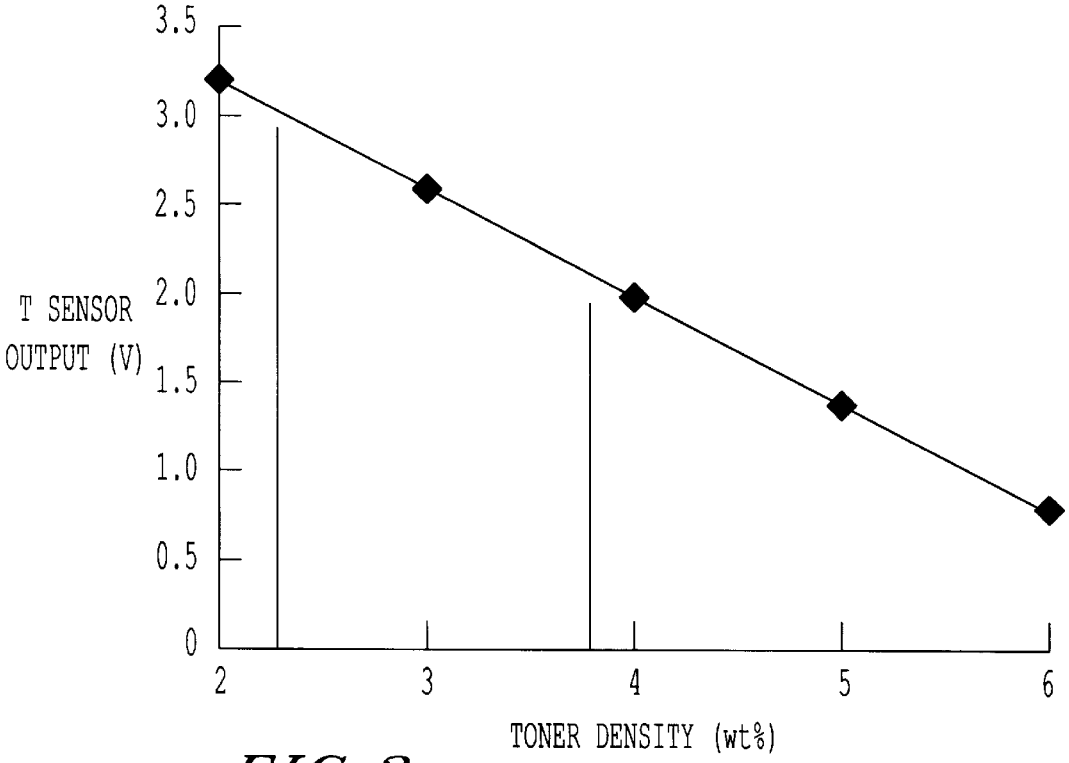
FIG. 2 is a diagram illustrating a relationship between toner density and the output of the "T" sensor.

Referring now to the drawings, wherein like reference numerals designate identical or corresponding parts throughout the several views, preferred embodiments of the present invention are now described.

Figure 3:
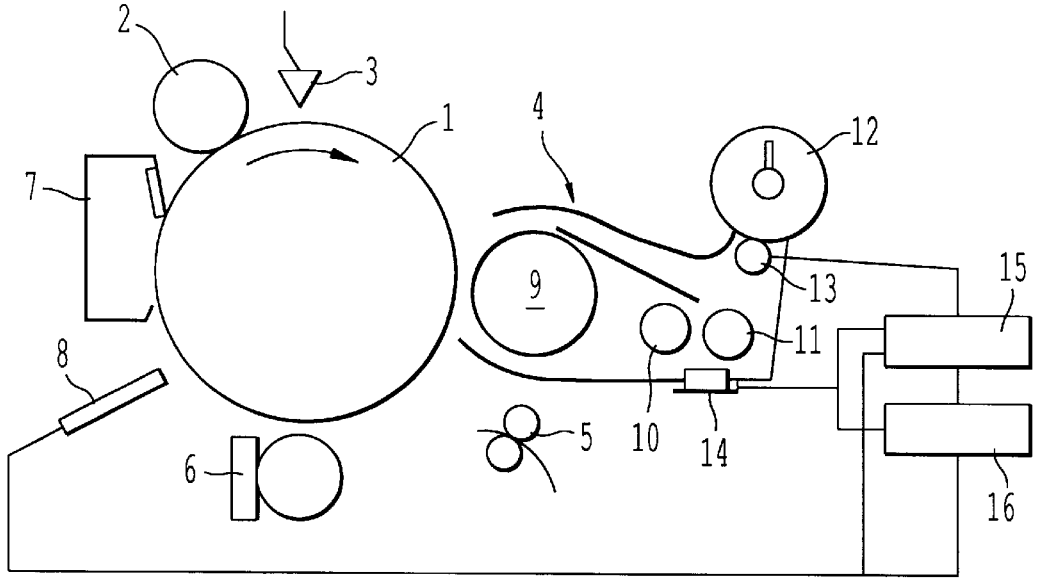
FIG. 3 is a schematic drawing illustrating an image forming apparatus according to an embodiment of the present invention.

FIG. 3 is a schematic drawing illustrating an electrophotographic image forming apparatus according to an embodiment of the present invention. In FIG. 3, a drum-like shaped photoconductor 1 as an image carrier is rotated by a rotation drive device (not shown) in a direction indicated by an arrow and is uniformly charged by a charging device 2. The photoconductor drum 1 is exposed with exposing light 3 from an exposure device (not shown), and thereby an electrostatic image of an image is formed on the surface of the photoconductor 1. The latent image is then developed by a developing device 4 with two-component developer, including carrier and toner, and thereby a visible toner image is formed on the surface of the photoconductor 1.

A transfer sheet is fed from a sheet supplying device (not shown) via a sheet conveying device 5 and the toner image on the photoconductor 1 is transferred onto the transfer sheet by a transfer device of a transfer and separation device 6. The transfer sheet is separated from the photoconductor 1 by a separation device of the transfer and separation device 6 after transfer of the toner image onto the transfer sheet. The toner image is then fixed onto the transfer sheet by a fixing device (not shown) and is then discharged outside of the apparatus. After transfer of the toner image onto the transfer sheet, residual toner on the surface of the photoconductor 1 is removed by a cleaning device 7.

An image forming operation as described above is started according to an instruction to start the image forming operation from an operation and display part (not shown) and the operation is repeated a number of times corresponding to the number of copies input by an operator via the operation and display part. When the image forming operation is started for a set number of copies, a criterion image is formed on the photoconductor 1. More specifically, after the photoconductor 1 is uniformly charged by the charging device 2, the charged photoconductor 1 passes the exposure unit which is not being operated or emitting light having a predetermined intensity. The developing potential, which is a difference between a surface potential of the photoconductor 1 and a developing bias potential of the developing device 4, is changed to a predetermined potential as a result of changing the developing bias potential of the developing device 4 to a predetermined potential by controlling a power source (not shown) for the developing bias potential with a control unit (not shown). A part of the surface of the photoconductor 1 having the predetermined developing potential is developed with toner by the developing device 4, and thereby a toner image of the criterion image is formed.

When the criterion image is formed on the photoconductor 1, the transfer and separation device 6 is not operated, and after the image density (i.e., the quantity of toner) of the criterion image is detected by a reflective-type photo-sensor 8, generally referred to as a "P" sensor, as an image density detection device, the toner image of the criterion image on the photoconductor 1 is removed by the cleaning device 7.

The developing device 4 includes a developing roller 9, a developing part including stirring rollers 10, 11, and a toner supplying device including a toner container 12 and a toner supplying part having a toner supplying roller 13. The developing roller 9 and the stirring rollers 10, 11 are rotationally driven by a same driving device (not shown) for the developing part. The developing part of the developing device 4 accommodates therein two-component developer including carrier and toner. The two-component developer is circulated inside the developing part and is stirred by rotation of the developing roller 9 and the stirring rollers 10, 11 as a developer stirring device.

The developing roller 9 magnetically attracts and carries thereon the developer which is stirred by the stirring rollers 10, 11 and conveys the developer as the developing roller 9 rotates, such that the electrostatic latent image on the photoconductor 1 is developed with toner, which is supplied by the developer carried on the developing roller 9, to be a visible toner image. The toner supplying roller 13 is rotated by a driving source (not shown) when a toner supplying clutch (not shown) is turned on, and toner contained in the toner container 12 is supplied into the developing part of the developing device 4 to be mixed with the developer contained therein. A permeability sensor 14, referred to as a "T" sensor, as a toner density detection device is provided inside the developing device 4 to detect the density of toner of the two-component developer in the developing device 4.

A toner supplying roller control device 15 and a criterion value correcting device 16 are provided between the developing device 4 and the "P" sensor 8, and the "T" sensor 14 and the "P" sensor 8 are connected with the toner supplying roller control device 15 and the criterion value correcting device 16, respectively. The driving part for the developing part, which rotates the developing roller 9 and the stirring rollers 10, 11, is controlled by a control unit (not shown) so as to be operated when the developing device 4 is operated for development. The toner supplying roller control device 15 and the criterion value correcting device 16 include a microcomputer, respectively, and constitute a toner density control device.

Figure 4:
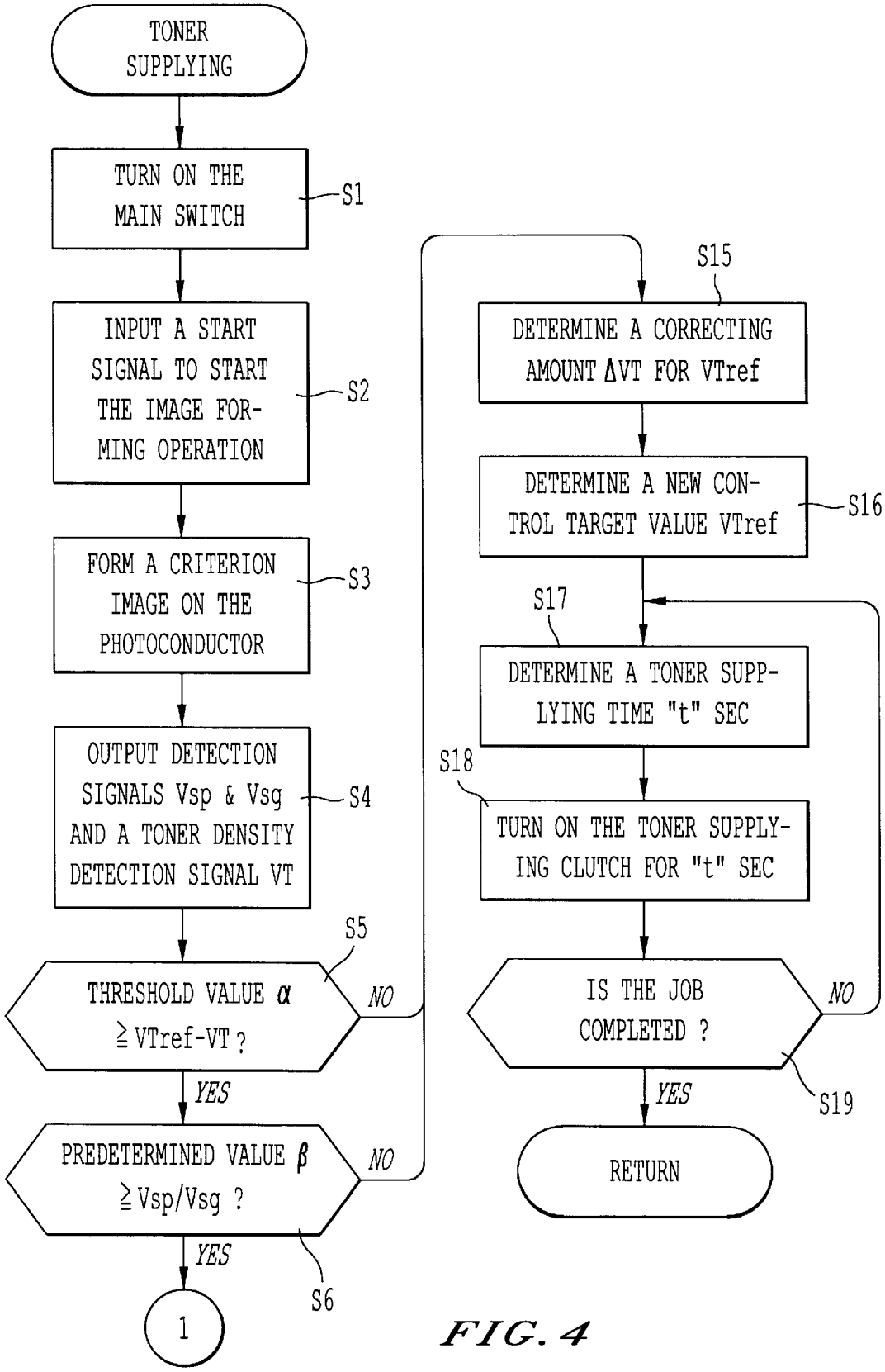
FIG. 4 is a flowchart illustrating a part of an exemplary operation of controlling the toner supply to a developing device of the image forming apparatus according to the present invention.
Figure 5:
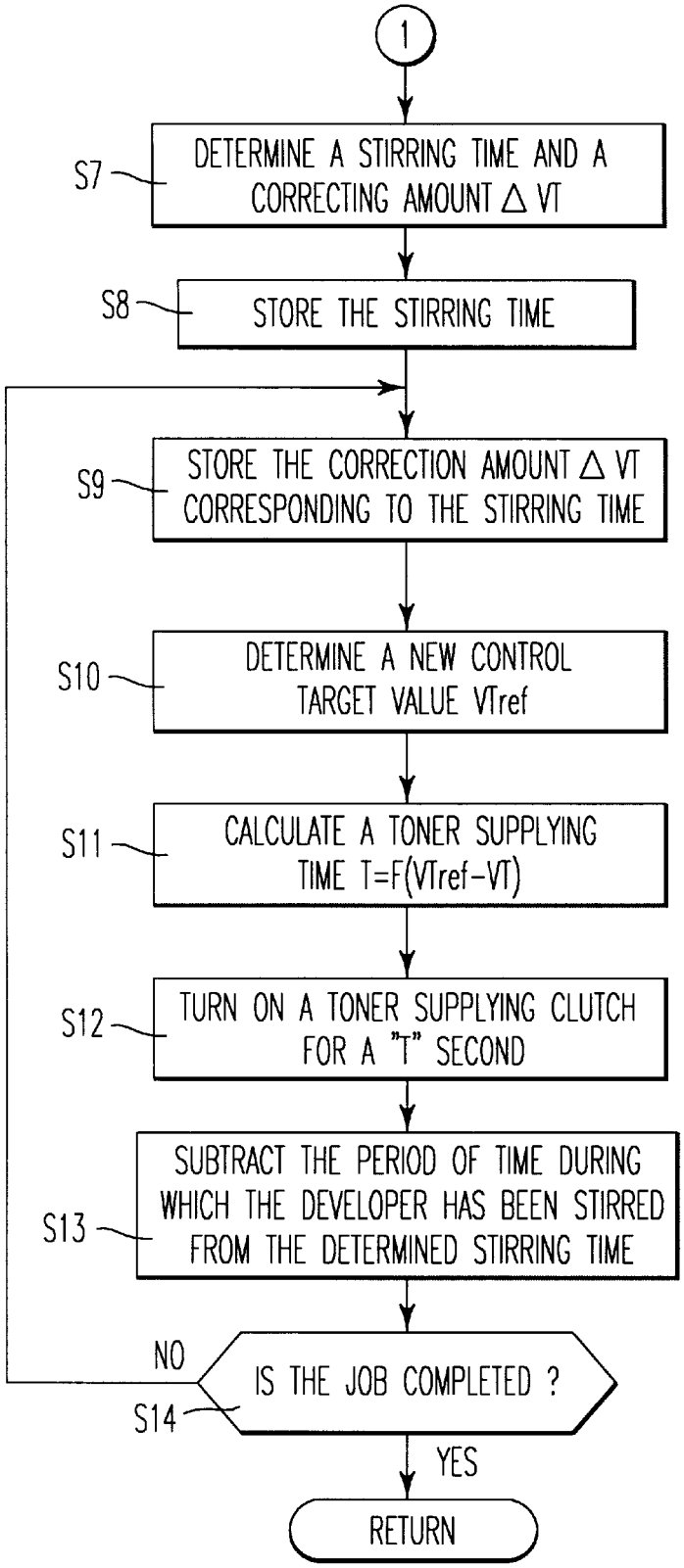
FIG. 5 is a flowchart illustrating another part of the toner supply control operation.

FIG. 4 and FIG. 5 are flowcharts illustrating an exemplary operation of controlling the toner supply to the developing device 4 for controlling the toner density in the above image forming apparatus according to the present invention. Step S1 turns on a main switch of the image forming apparatus. Step S2 inputs an instruction signal to start an image forming operation for a number of copies which is set by an operator via an operation display panel of the image forming apparatus. Step S3 forms a criterion image on the photoconductor 1 as described above. In step S4, the "P" sensor 8 detects the image density of the criterion image and the density of a background portion (non-image area) on the photoconductor 1 and outputs a detection signal Vsp for the criterion image and a detection signal Vsg for the background portion, and further the "T" sensor 14 detects the toner density of the two-component developer in the developing device 4 and outputs a detection signal VT. In addition, the toner supplying roller control device 15 and the criterion value correcting device 16 receive the detection signals Vsp and Vsg from the "P" sensor 8 and the detection signal VT from the "T" sensor 14, respectively.

In step S5, the criterion value correcting device 16 calculates a difference between the output value of the detection signal VT of the "T" sensor 14 and a predetermined criterion value VTref for the toner density (a criterion value for controlling the toner density), and then determines if the value of the difference is equal to or less than a predetermined threshold value $\alpha$. When the difference is equal to or less than the threshold value $\alpha$, i.e. Yes in step S5, in step S6 the criterion value correcting device 16 determines if the output value of the "P" sensor 8, i.e., the value of a ratio between the detection signal Vsp and the detection signal Vsg from the "P" sensor 8, i.e. Vsp/Vsg, is equal to or greater than a predetermined value $\beta$.

When the value of Vsp/Vsg is equal to or less than the value $\beta$, i.e. Yes in step S6, in step S7 (see FIG. 5) the criterion value correcting device 16 activates a stirring mode, according to a table 1 of FIG. 6 which is pre-stored in a memory of the criterion value correcting device 16, to stir the developer in the developing device 4 with the developing roller 9 and the stirring rollers 10, 11 while correcting the criterion value VTref as the stirring time progresses as described later. The step S7 further determines a stirring time to stir the developer and a corresponding correcting amount $\Delta$VT for VTref in accordance with the difference between the predetermined criterion value VTref and the output value of the detect signal VT from the "T" sensor, i.e., VTref−VT, according to a table 2 illustrated in FIG. 7, which is also pre-stored.

Then, in step S8, the toner supplying roller control device 15 stores the developer stirring time determined by the criterion value correcting device 16 according to the table 2 of FIG. 7, and, in step S9, stores the correcting amount $\Delta$VT for VTref corresponding to the determined developer stirring time. Then, in step S10, the toner supplying roller control device 15 corrects the criterion value VTref with the correcting amount $\Delta$VT for VTref which is stored and sets the corrected criterion value VTref as a new criterion value for controlling the toner density.

Then, in step S11, the toner supplying roller control device 15 compares the new criterion value VTref to the output value of the above detect signal VT from the "T" sensor 14 and calculates a toner supplying time ("t" sec)

based upon the difference between the new criterion value VTref and the output value of the detect signal VT with a functional equation t=f(VTref−VT).

Then, in step S12, the toner supplying control device 15 turns on a toner supplying clutch (not shown) for the time "t" to rotate the toner supplying roller 13 so as to supply toner to the developing device 4 from the toner container 12 and, at the same time, activates the driving device for the developing part to rotate the developing roller 9 and the stirring rollers 10 and 11. Thus, the two-component developer is stirred by the stirring rollers 10 and 11.

In step S13, the toner supplying roller control device 15 subtracts the period of time, i.e., the toner supplying time "t", during which the developer has been stirred as the toner is supplied from the toner container 12, from the developer stirring time determined above so as to obtain a remaining stirring time. In step S14, it is determined if the job has been completed, i.e., if the remaining stirring time has become zero and stirring of the developer for the stirring time determined above has been completed. If the job has not been completed, i.e. No in step S14, the operation returns to step S9 and the steps S9 through S14 are repeated until the job is completed, i.e. until Yes in step S14. In the above repeat process, in step S9, the toner supplying roller control device 15 determines a new correcting amount ΔVT for the criterion value VTref based upon the remaining stirring time (the remaining stirring time after the above toner supplying time "t" has been subtracted from the developer stirring time determined above) in accordance with the table 2 of FIG. 7 and stores the new correcting amount ΔVT for the criterion value VTref corresponding to the remaining developer stirring time. Another new criterion value VTref is determined based upon the above new correcting amount ΔVT in step S10 and a new toner supplying time "t" is determined based upon the above another new criterion value VTref and the output value of a detection signal VT from the "T" sensor in step S11, and the subsequent steps S12, S13 and S14 are performed in substantially the same manner as above.

When the job is completed, i.e., when the remaining stirring time has become zero and stirring of the developer has been completed for the developer stirring time determined above, and Yes in step S14, the toner supplying roller control device 15 sets the correcting amount ΔVT for the criterion value VTref to zero in accordance with the table 2 of FIG. 7 and turns off the toner supplying clutch so as to release the stirring mode.

When the difference between the value of the detection signal VT and the criterion value VTref is not equal to or less than α in step S5 or the value of Vsp/Vsg is not equal to or less than β in step S6, i.e. No in steps S5 and S6, then in step S15 (FIG. 4), the criterion value correcting device 16 determines a correcting amount ΔVT for VTref based upon the difference between the predetermined VTref and the output value of the detection signal VT from the "T" sensor and the value of Vsp/Vsg in accordance with the correction table 1 illustrated in FIG. 6.

In step S16, the toner supplying control device 15 corrects the criterion value VTref with the correcting amount ΔVT for VTref and determines (VTref+ΔVT) as a new criterion value VTref for the toner density. In step S17, the toner supplying control device 15 compares the new criterion value VTref with the output value of the detection signal VT from the "T" sensor and determines a toner supplying time ("t" second) based upon the difference (VTref−VT) with a functional equation t=f(VTref−VT).

In step S18, the toner supplying control device 15 turns on the toner supplying clutch for the time "t" to rotate the toner supplying roller 13 so as to supply toner to the developing part of the developing device 4 from the toner container 12. Then, the toner supplying control device 15 determines, in step S19, if the job has been completed, i.e., if the remaining toner supplying time has become zero and supplying of toner has been completed. If the job has not been completed, i.e. No in step S19, the operation returns to the step S17 and the steps S17 and S18 are repeated to continue toner supplying. When the job is completed, i.e., when the remaining toner supplying time has become zero and supplying of toner has been completed and Yes in step S19, the toner supplying control device 15 turns off the toner supplying clutch to terminate the toner supplying operation.

More specifically, in this embodiment, when the developer is initially put in the image forming apparatus, the toner density of the developer is set to 4.0 wt % and the criterion value VTref for the toner density at 2.5.

Referring to FIGS. 6 and 7, for example, when the output detection signal value VT of the "T" sensor is 2.7 V, the difference between the criterion value VTref and the output value VT of the "T" sensor (VTref−VT) is −0.2 from 2.5–2.7, and when the ratio of output detection signal values Vsp and Vsg (Vsp/Vsg) is 0.17, from the table 1 of FIG. 6, the correcting amount ΔVT for the criterion value VTref is −0.1. Consequently, the new criterion value VTref for the toner density becomes 2.4 V from a new VTref equals a previous Vtref plus ΔVT, i.e. $VTref_{new}=VTref_{previous}+\Delta VT=2.5-0.1=2.4$, and toner supplying is performed for a toner supplying time t=f(VTref−VT) sec. until the next criterion image density detection is performed by the "P" sensor 8.

Similarly, when the output detection signal value of the "T" sensor 14 is 3.1 V, the difference between the criterion value VTref and the output value VT of the "T" sensor (VTref−VT) is −0.6, and when the ratio of output detection signal values Vsp and Vsg (Vsp/Vsg) is 0.07, according to the table 1 of FIG. 6, the stirring mode is activated, and in accordance with the table 2 of FIG. 7, the stirring time of 400 sec is stored and the correcting amount ΔVT for the criterion value VTref becomes 0.4 based upon the table 2 of FIG. 7, and the new criterion value VTref is 2.9 V from a $VTref_{new}=VTref_{previous}+\Delta VT=2.5+0.4=2.9$. When the remaining stirring time becomes 150 sec. as the image forming operation progresses, the correcting amount ΔVT for VTref becomes 0.2 from the table 2 of FIG. 7, and the next criterion value VTref becomes 2.7 V from VTref=2.5+0.2, and toner is supplied for the toner supplying time t=f(VTref−VT)sec.

In this embodiment, detection of image density of the criterion image with the "P" sensor is performed each time when an image forming operation is started for a specified number of copies. However, detection of image density of the criterion image may be performed also only when the main power is turned on and an instruction to start an image forming operation is not input, or at other times.

Further, although the value of a ratio between a detection signal Vsp and a detection signal Vsg of the "P" sensor is used as the output value of the "P" sensor, the value of the detection signal Vsp may be used instead of the value of Vsp/Vsg.

Numerous additional modifications and variations of the present invention are possible in light of the above teachings. It is therefore to be understood that within the scope of the appended claims, the present invention may be practiced otherwise than specifically described herein.

This document claims priority and contains subject matter related to Japanese patent application No. 10-292215 filed in the Japanese Patent Office on Oct. 14, 1998, and the entire contents of which are hereby incorporated herein by reference.

What is claimed is:

1. An image forming apparatus, comprising:

an image carrier;

means for developing a latent image formed on the image carrier by applying two-component developer including toner onto the latent image, the developing means including a developing part containing the two-component developer and means for stirring the two-component developer;

means for supplying toner to the developing part of the developing means;

means for detecting a toner density of the two-component developer in the developing means;

means for calculating a difference between an output value VT of the toner density detection means and a criterion value VTref for controlling the toner density of the two-component developer and controlling the toner supplying means based upon the difference;

means for detecting an image density of a criterion image formed on the image carrier; and means for correcting the criterion value VTref based upon an output value of the criterion image density detection means, wherein the stirring means is operated based upon determining a difference between the criterion value VTref and the output value VT of the toner density detecting means and an output value of the criterion image density detecting means when an image forming operation is started.

2. An image forming apparatus according to claim 1, wherein a stirring time to stir the developer in the developing means with the stirring means is further determined when the image forming operation is started.

3. An image forming apparatus according to claim 2, wherein the developer stirring time is determined according to the difference between the criterion value VTref and the output value VT of the toner density detecting means when the image forming operation is started.

4. An image forming apparatus according to claim 3, wherein the criterion value VTref is corrected based upon the developer stirring time.

5. An image forming apparatus according to claim 4, wherein a correcting amount for the criterion value VTref is determined according to the developer stirring time.

6. An image forming apparatus according to claim 1, wherein the stirring means is operated when the difference between the criterion value VTref and the output value VT of the toner density detect means is equal to or less than a threshold value and the output value of the criterion image density detect means is equal to or less than a predetermined value.

7. An image forming apparatus according to claim 6, wherein toner density of the developer in the developing means is less than a predetermined level when the difference between the criterion value VTref and the output value VT of the toner density detecting means is equal to or less than the threshold value and image density of the criterion image is greater than a predetermined level when the output value of the criterion image density detecting means is equal to or less than the predetermined value.

8. An image forming apparatus, comprising:

an image carrier;

means for developing a latent image formed on the image carrier by applying two-component developer, including toner, onto the latent image, the developing means including a developing part containing the two-component developer and means for stirring the two-component developer;

means for supplying toner to the developing part of the developing means;

means for detecting a toner density of the two-component developer in the developing means;

means for calculating a difference between an output value VT of the toner density detecting means and a criterion value VTref for controlling the toner density of the two-component developer and controlling the toner supplying means based upon the difference;

means for detecting an image density of a criterion image formed on the image carrier; and means for correcting the criterion value VTref based upon an output value of the criterion image density detecting means, wherein the stirring means is operated and the criterion value VTref is corrected based upon determining a difference between the criterion value VTref and the output value VT of the toner density detecting means and an output value of the criterion image density detecting means when an image forming operation is started.

9. An image forming apparatus according to claim 8, wherein the stirring means is operated and the criterion value VTref is corrected when the difference between the criterion value VTref and the output value VT of the toner density detecting means is equal to or less than a threshold value and the output value of the criterion image density detecting means is equal to or less than a predetermined value.

10. An image forming apparatus, comprising:

an image carrier;

a developing device configured to develop a latent image formed on the image carrier by applying two-component developer, including toner, onto the latent image, the developing device including a developing part containing the two-component developer and a developer stirring device configured to stir the two-component developer;

a toner supplying device configured to supply toner to the developing part of the developing device;

a toner density detection device configured to detect a toner density of the two-component developer in the developing device;

a toner control device configured to calculate a difference between an output value VT of the toner density detect device and a criterion value VTref for controlling the toner density of the two-component developer and to control the toner supplying device based upon the difference;

an image density detection device configured to detect an image density of a criterion image formed on the image carrier; and a criterion value correcting device to correct the criterion value VTref based upon an output value of the criterion image density detection device, wherein the developer stirring device is operated based upon determining a difference between the criterion value VTref and the output value VT of the toner density detection device and an output value of the criterion image density detection device when an image forming operation is started.

11. An image forming apparatus according to claim 10, wherein a stirring time to stir the developer in the developing device with the developer stirring device is further determined when the image forming operation is started.

12. An image forming apparatus according to claim 11, wherein the developer stirring time is determined according to the difference between the criterion value VTref and the output value VT of the toner density detection device when the image forming operation is started.

13. An image forming apparatus according to claim 12, wherein the criterion value VTref is corrected based upon the developer stirring time.

14. An image forming apparatus according to claim 13, wherein a correcting amount for the criterion value VTref is determined according to the developer stirring time.

15. An image forming apparatus according to claim 10, wherein the developer stirring device is operated when the difference between the criterion value VTref and the output value VT of the toner density detection device is equal to or less than a threshold value and the output value of the criterion image density detection device is equal to or less than a predetermined value.

16. An image forming apparatus according to claim 15, wherein the toner density of the developer in the developing device is less than a predetermined level when the difference between the criterion value VTref and the output value VT of the toner density detection device is equal to or less than the threshold value and the image density of the criterion image is greater than a predetermined level when the output value of the criterion image density detection device is equal to or less than the predetermined value.

17. An image forming apparatus, comprising:

an image carrier;

a developing device configured to develop a latent image formed on the image carrier by applying two-component developer, including toner, onto the latent image, the developing device including a developing part containing the two-component developer and a developer stirring device configured to stir the two-component developer;

a toner supplying device configured to supply toner to the developing part of the developing device;

a toner density detection device configured to detect a toner density of the two-component developer in the developing device;

a toner control device configured to calculate a difference between an output value VT of the toner density detection device and a criterion value VTref for controlling the toner density of the two-component developer and to control the toner supplying device based upon a result of the difference;

an image density detection device configured to detect an image density of a criterion image formed on the image carrier; and a criterion value correcting device configured to correct the criterion value VTref based upon an output value of the criterion image density detection device, wherein the developer stirring device is operated and the criterion value VTref is corrected based upon determining a difference between the criterion value VTref and the output value VT of the toner density detection device and an output value of the criterion image density detection device when an image forming operation is started.

18. An image forming apparatus according to claim 17, wherein the developer stirring device is operated and the criterion value VTref is corrected when the difference between the criterion value VTref and the output value VT of the toner density detection device is equal to or less than a threshold value and the output value of the criterion image density detection device is equal to or less than a predetermined value.

19. A method of controlling toner density of developer in a developing device of an image forming apparatus, comprising the steps of:

detecting the toner density of the developer;

controlling a toner supplying device supplying toner to the developing device based upon a difference between the detected toner density and a criterion value for the toner density;

detecting an image density of a criterion image formed on an image carrier of the apparatus; and stirring the developer based upon determining the difference between the detected toner density and the criterion value for the toner density and the detected image density of the criterion image.

20. A method according to claim 19, wherein a stirring time to stir the developer is determined when an image forming operation is started.

21. A method according to claim 20, wherein the developer stirring time is determined according to the difference between the criterion value and the detected toner density.

22. A method according to claim 21, wherein the criterion value is corrected based upon the developer stirring time.

23. A method according to claim 22, wherein a correcting amount for the criterion value is determined according to the developer stirring time.

24. A method according to claim 19, wherein the developer is stirred when the difference between the criterion value and the detected toner density is equal to or less than a threshold value and the detected image density of the criterion image is equal to or less than a predetermined value.

25. A method according to claim 24, wherein the toner density of the developer is less than a predetermined level when the difference between the criterion value and the detected toner density is equal to or less than the threshold value and the image density of the criterion image is greater than a predetermined level when the detected image density of the criterion image is equal to or less than the predetermined value.

* * * * *